US009873541B2

(12) United States Patent
Earnshaw

(10) Patent No.: US 9,873,541 B2
(45) Date of Patent: Jan. 23, 2018

(54) RAPID ASSEMBLING CONTAINER

(71) Applicant: Connecticut Container Corp., North Haven, CT (US)

(72) Inventor: Gerald C. Earnshaw, Naugatuck, CT (US)

(73) Assignee: Connecticut Container Corp., North Haven, CT (US)

( * ) Notice: Subject to any disclaimer, the term of this patent is extended or adjusted under 35 U.S.C. 154(b) by 0 days.

(21) Appl. No.: 14/998,125

(22) Filed: Dec. 24, 2015

(65) Prior Publication Data

US 2017/0183118 A1 Jun. 29, 2017

(51) Int. Cl.

| | |
|---|---|
| ***B65D 5/20*** | (2006.01) |
| ***B31B 1/60*** | (2006.01) |
| ***B31B 3/60*** | (2006.01) |
| ***B65D 5/42*** | (2006.01) |
| ***B31B 50/60*** | (2017.01) |
| *B31B 50/26* | (2017.01) |
| *B31B 100/00* | (2017.01) |
| *B31B 50/73* | (2017.01) |
| *B31B 110/35* | (2017.01) |

(52) U.S. Cl.

CPC ..... *B65D 5/2042* (2013.01); *B31B 50/60* (2017.08); *B65D 5/4266* (2013.01); *B31B 50/26* (2017.08); *B31B 50/732* (2017.08); *B31B 2100/00* (2017.08); *B31B 2110/35* (2017.08)

(58) Field of Classification Search

CPC .... B65D 5/2042; B65D 5/4266; B65D 5/248; B65D 5/24; B31B 31/60; B31B 3/60

USPC ..... 229/115, 122.32, 186, 149, 179, 188, 229/125.28, 177; 493/136, 405, 89

See application file for complete search history.

(56) References Cited

U.S. PATENT DOCUMENTS

| | | | | |
|---|---|---|---|---|
| 2,910,220 A * | 10/1959 | Hamilton | ..... | B65D 5/2038 229/120 |
| 4,238,069 A * | 12/1980 | Morris, Jr. | ..... | B65D 5/2047 229/114 |
| 4,361,236 A * | 11/1982 | Lavery | ..... | B65D 5/248 206/807 |
| 8,701,976 B2 | 4/2014 | Earnshaw | | |

* cited by examiner

*Primary Examiner* — Christopher Demeree
(74) *Attorney, Agent, or Firm* — Wiggin and Dana LLP; Gregory S. Rosenblatt; Jonathan D. Hall

(57) ABSTRACT

A storage container includes a bottom panel that has a parallel front edge and rear edge, and a parallel first and second side edge. A front panel is connected to the bottom panel along the front edge and is further connected with a front locking section. A first side panel is connected to the first side edge of the bottom panel and is further connected to a first side locking section. A second side panel is connected to the second side edge of the bottom panel and is further connected to a second side locking section. A rear panel is connected to the rear edge of the bottom panel and is further connected to a rear locking section. The rear panel has four deltoidal sections. The container is configured for rapid assembly.

5 Claims, 7 Drawing Sheets

RAPID ASSEMBLING CONTAINER

FIELD OF THE DISCLOSURE

The subject matter of the present disclosure generally relates to containers, and more particularly relates to containers that can be rapidly assembled.

BACKGROUND OF THE DISCLOSURE

Containers made from paperboard or cardboard are well known. For instance, U.S. Pat. No. 8,701,976, entitled "Shipping container" and filed Aug. 2, 2011, discloses a shipping container that has a lid locked using pressure, rather than friction. The disclosure of U.S. Pat. No. 8,701,976 is hereby incorporated by reference herein in its entirety. It is convenient to shape a flat blank of cardboard and provide the blank with score lines, and then construct the container by folding the blank when the container is needed. Such containers often require fasteners to assemble, which requires the use of different materials and the separate provision of such fasteners to those assembling the containers. In many instances construction of such containers requires a user to remove large portions of the blank, which are wasted, and also to expend significant effort and time to make the required folds and undertake the necessary assembly steps. Also, often assembly of such containers requires gluing or affixing numerous areas together, which requires the use of significant amounts of adhesive and additional time and expense. When such effort is required for large numbers of containers, such as when they are assembled at a store for use in displays, these difficulties are compounded. Further, training is required of large numbers of employees when many stores are involved, further increasing the necessary effort and time for assembly.

The subject matter of the present disclosure is directed to overcoming, or at least reducing the effects of, one or more of the problems set forth above.

BRIEF SUMMARY OF THE DISCLOSURE

Disclosed is container capable of being rapidly assembled. In a preferred embodiment, the container has a bottom panel which is connected to a front panel, and the front panel to a locking section. The bottom panel is also connected to two side panels, each connected in turn to a locking section. A rear panel is connected to the bottom panel and to a bottom locking section. The rear panel includes four deltoidal sections, two of which are glued to the adjacent side panels. The container can be assembled rapidly by folding the panels together to form walls, which are locked in place in part by the locking sections. Tabs that are configured for insertion into slots, together with flaps, aid in securing the container into a rigid configuration.

BRIEF DESCRIPTION OF THE DRAWINGS

The foregoing summary, preferred embodiments, and other aspects of the present disclosure will be best understood with reference to a detailed description of specific embodiments, which follows, when read in conjunction with the accompanying drawings, in which.

Like reference numbers and designations in the various drawings indicate like elements.

DETAILED DESCRIPTION

Disclosed is a container suited for rapid assembly requiring less effort, time, and materials than previous designs.

Figure 1:
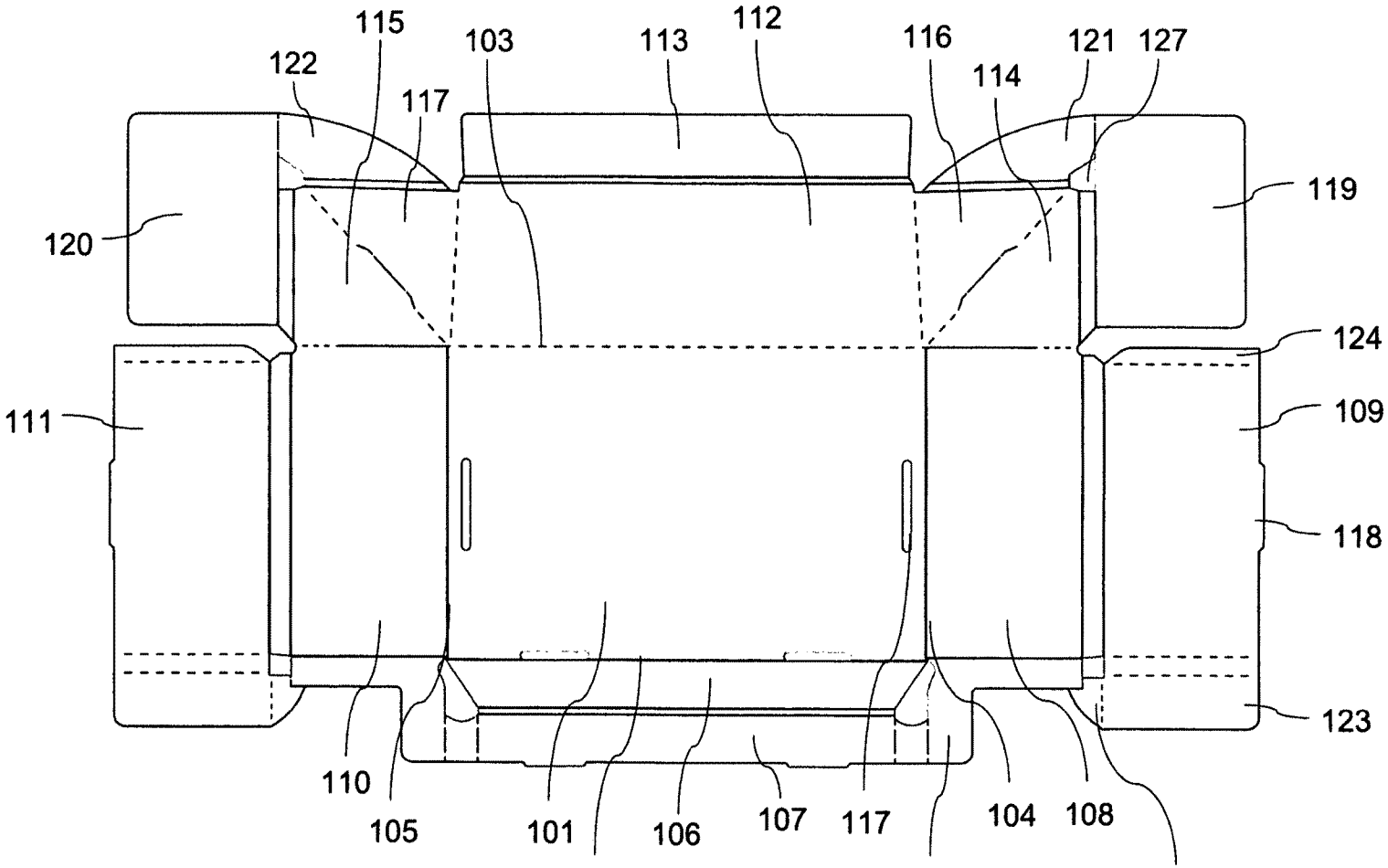
FIG. 1 is schematic view of a blank according to an embodiment.

FIG. 1 is a schematic illustration of a storage container blank according to an embodiment. Bottom panel 101 has a front edge 102 and a parallel rear edge 103. Bottom panel 101 also has a first side edge 104 that is parallel to a second side edge 105. Front panel 106 is connected to front edge 102 and further to front locking section 107. A first side panel 108 is connected to first side edge 104 and to a first side locking section 109. A second side panel 110 is connected to second side edge 105 and to a second side locking section 111. Rear panel 112 is connected to rear edge 103 and to rear locking section 113. Rear panel has a first deltoidal section 114, second deltoidal section 115, third deltoidal section 116 and fourth deltoidal section 117.

Bottom panel 101 has slots 117 that are configured for interlocking with tabs 118. Intermediate panels 119 and 120 are connected to deltoidal sections 114 and 115. Deltoidal section 116 and intermediate panel 119 are connected to mating panel 121. Deltoidal section 117 and intermediate panel 120 are connected to mating panel 122. The convex shape of the outer edge of mating panels 121 and 122 aid in allowing a user to assemble the container. Locking flaps 123 and 124 are affixed to first side locking panel 109. L-shaped locking flap 125 is connected with first side panel 108 and is configured to interlock with front locking section 107 to maintain the container in its assembled configuration. Shaded sections 127 are removed by the user prior to assembly. Flap 123 has rounded edge 128 which eases in the assembly of the container.

Connections between the panels and sections can optionally be made by double folding joints (indicated in FIG. 1 by double solid lines or by) or by perforation scoring (indicated in FIG. 1 by dashed lines). Perforation scoring is a series of small cuts in a linear form breaking both surfaces of the substrate. It allows for an easier fold, and in the present application allows the end user to fold in reverse. Folding joints may take the form of linear depressions in the substrate. Embodiments may optionally be made from cardboard, which may be corrugated.

Figure 2A:
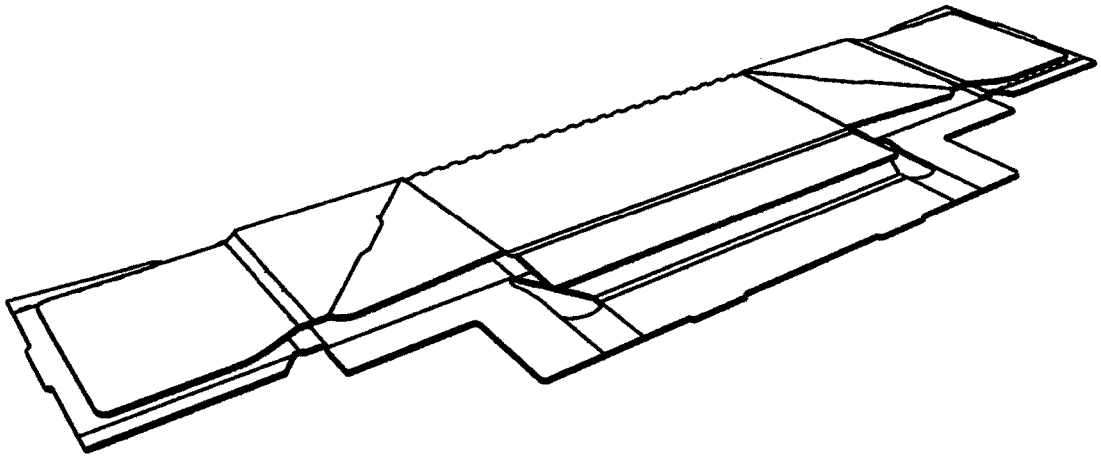
FIGS. 2A-G illustrate the steps for assembling an embodiment.

To assemble the container, adhesive is applied to deltoidal sections 114 and 115, after which the rear panel is folded over on the side panels as shown in FIG. 2A.

Figure 2B:
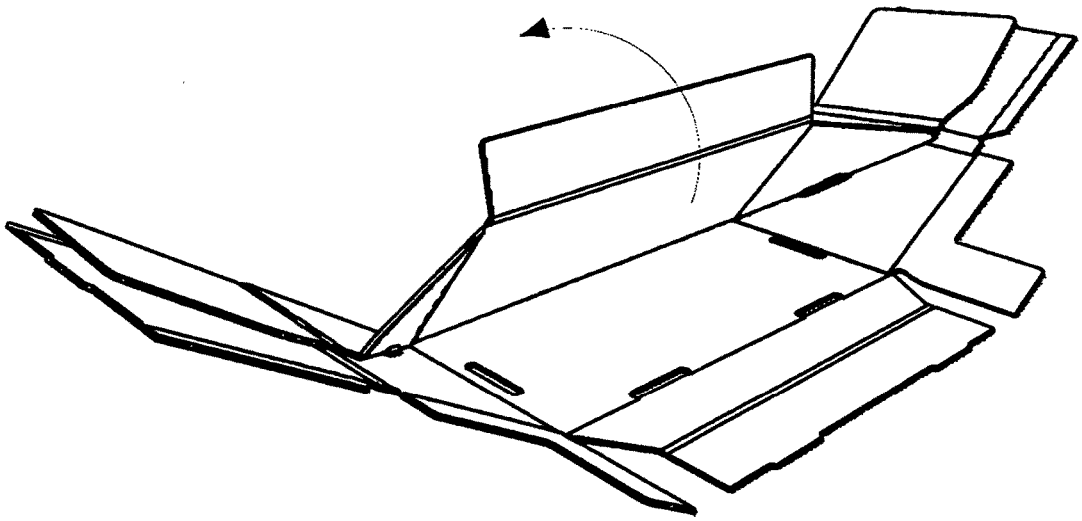
Figure 2C:
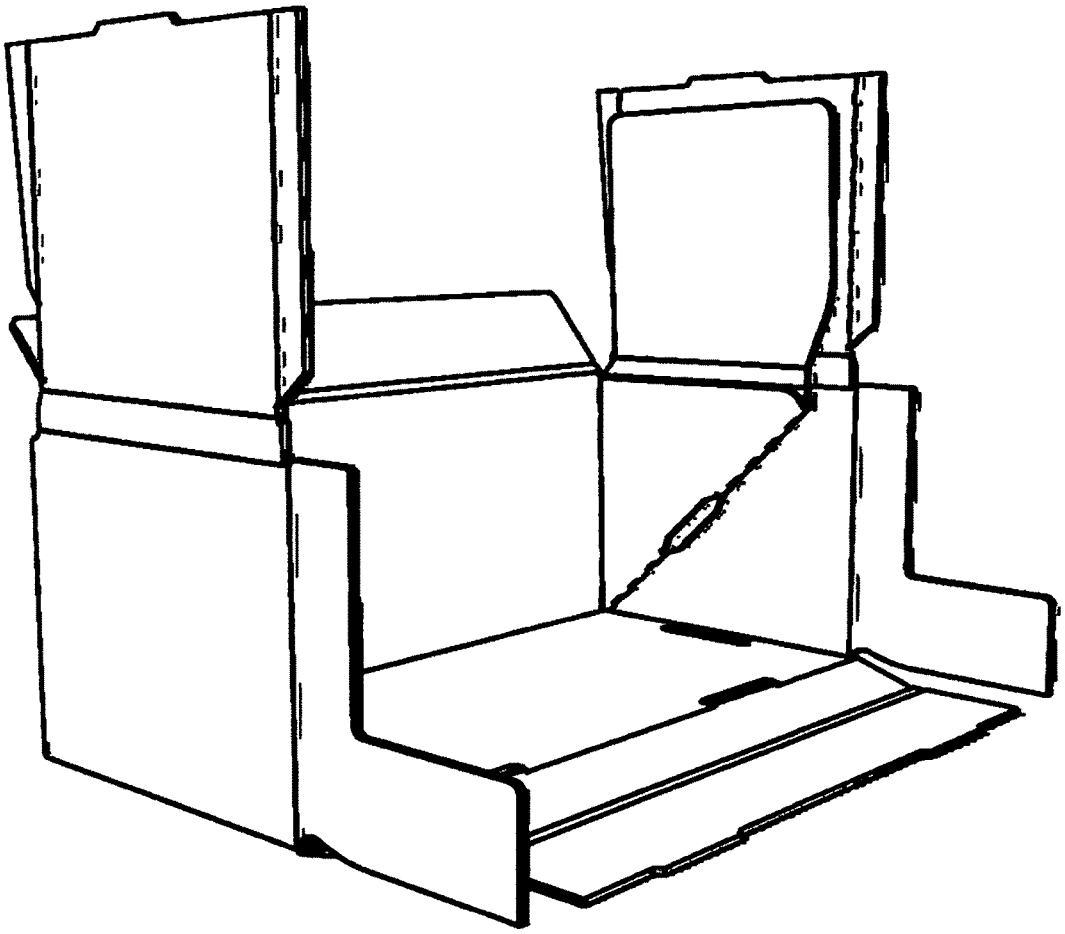
Figure 2D:
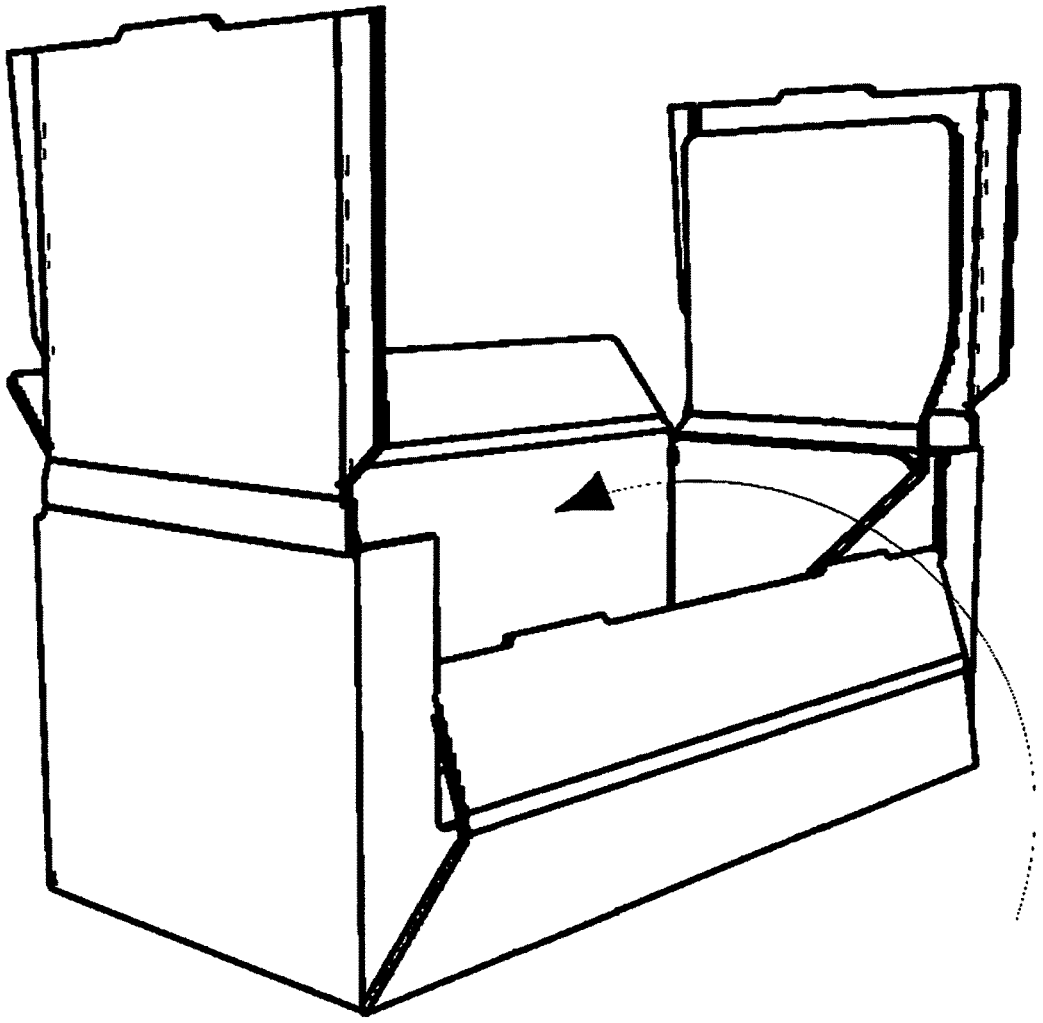
Figure 2E:
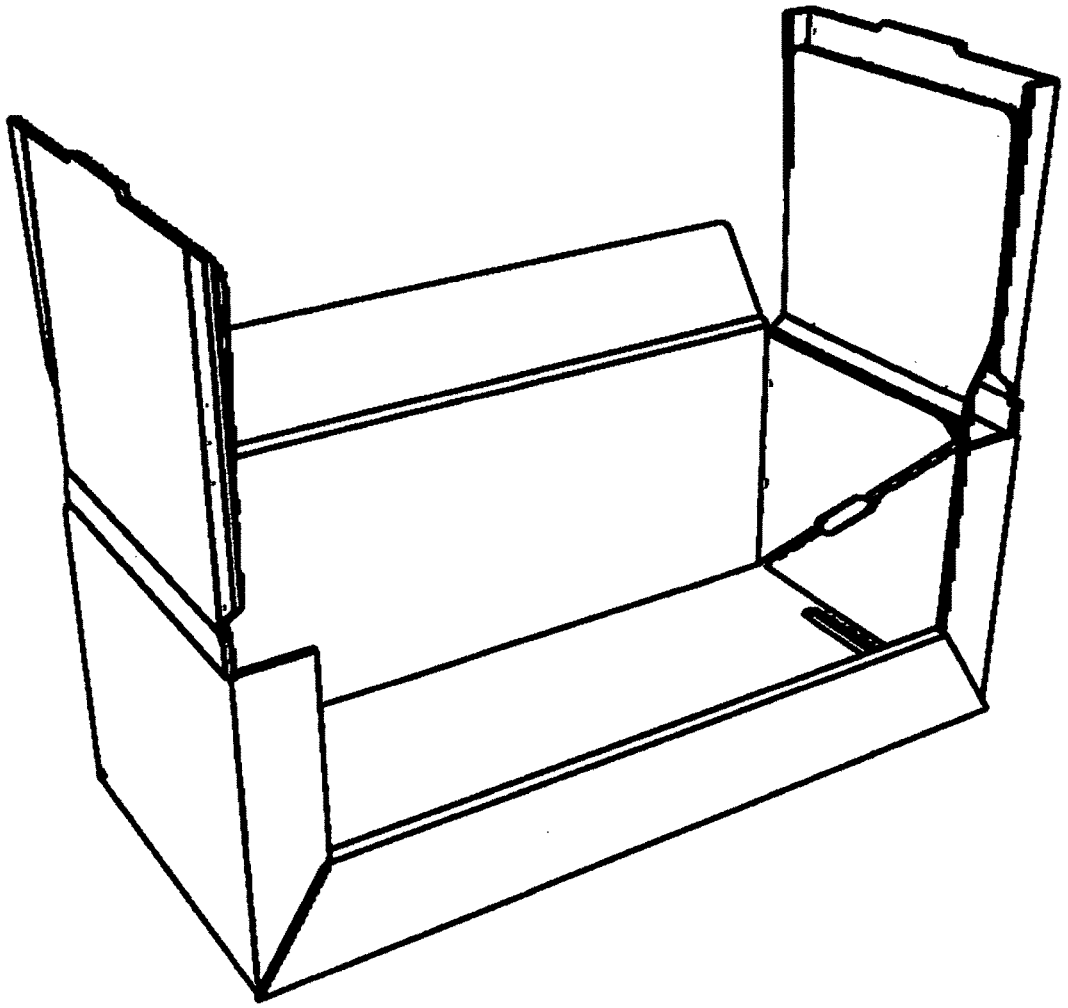
Figure 2F:
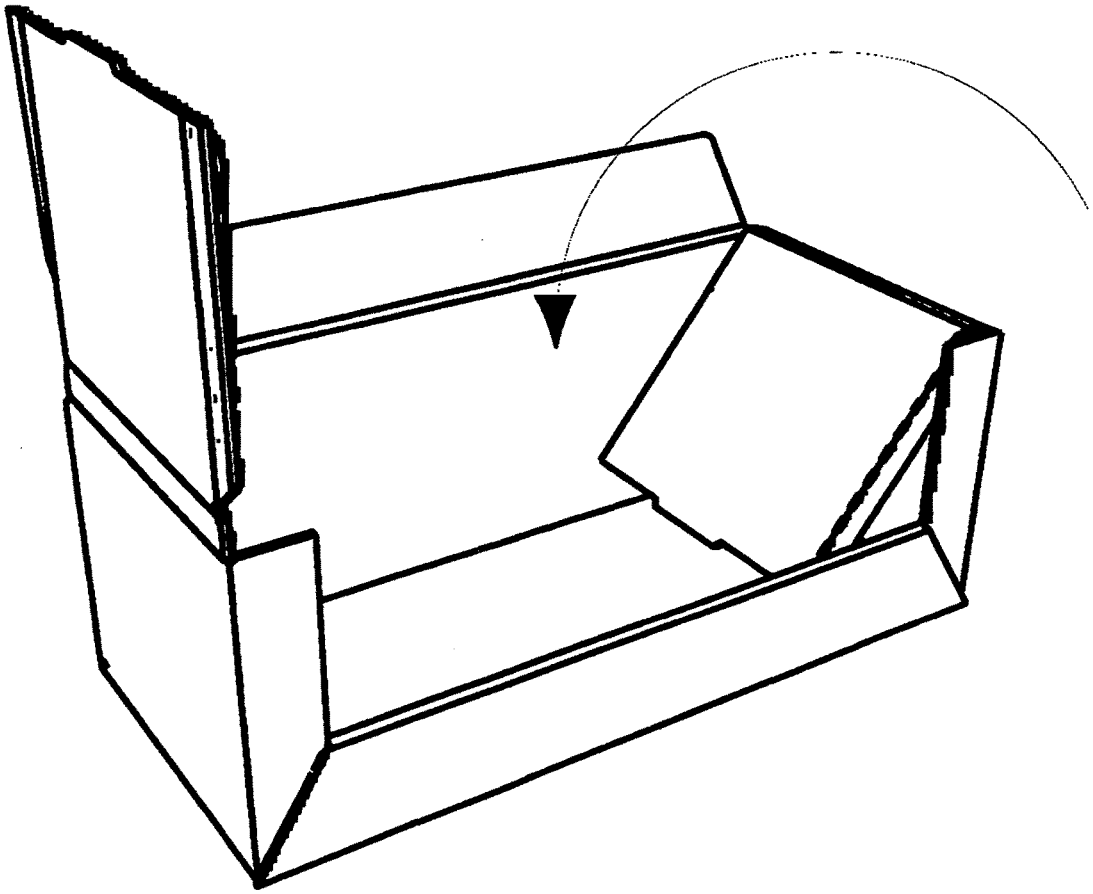
Figure 2G:
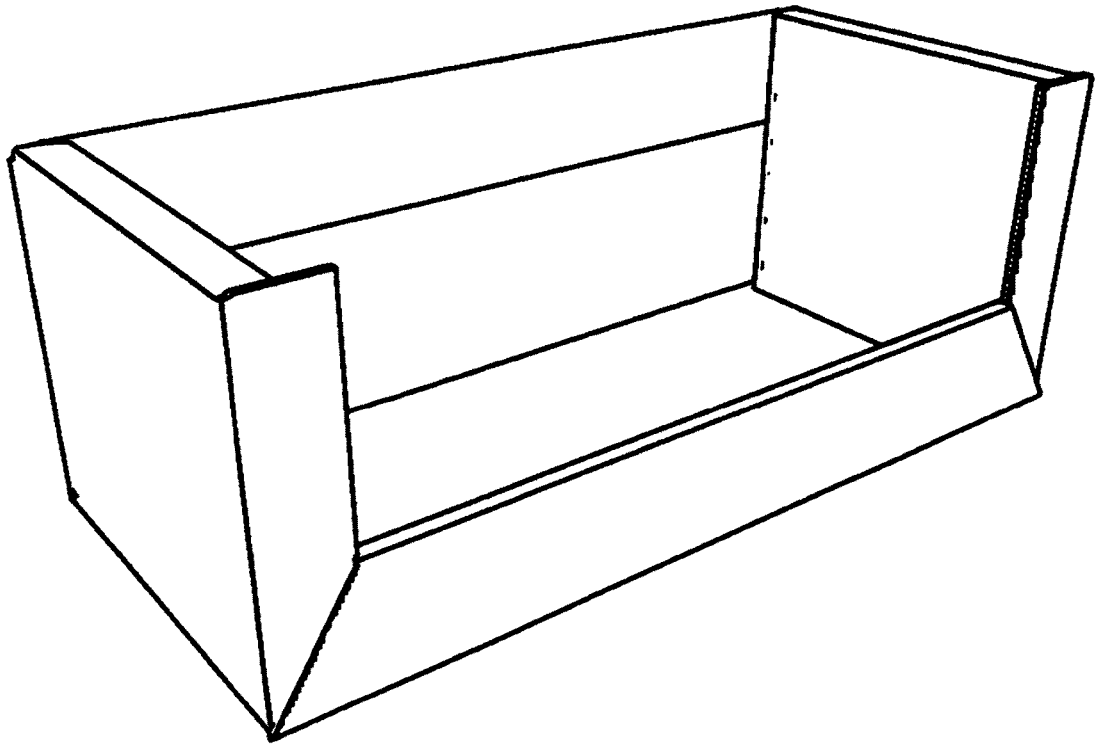

The rear panel is then rotated back as shown in FIG. 2B. Next, the side panels are raised to form walls as shown in FIG. 2C. As shown in FIG. 2D, the front locking section is then folded over to secure a front wall of the container. As shown in FIGS. 2E and 2F, the side locking sections are then secured in place. Lastly, as shown in FIG. 2G, the rear locking section is then secured in place to complete the assembly of the container.

The disclosed container has several advantages over previous design. The container as a whole has a profile which minimizes open spaces, meaning that the container has a smaller footprint when in a flat packed form. This drastically reduces the volume required to ship units of the container and thus reduces the associated costs for shipping and storage. Minimal adhesive is required to complete the assembly, reducing the time required for assembly and reducing material costs. Assembly requires few steps to complete, meaning the container can be assembled quickly and with little training. Optionally, a jig can be employed to further speed the process of assembly.

The terms "bottom", "below", "top" and "above" as used herein do not necessarily indicate that a "bottom" component is below a "top" component, or that a component that is "below" is indeed "below" another component or that a component that is "above" is indeed "above" another component as such directions, components or both may be flipped, rotated, moved in space, placed in a diagonal orientation or position, placed horizontally or vertically, or similarly modified. Accordingly, it will be appreciated that the terms "bottom", "below", "top" and "above" may be used herein for exemplary purposes only, to illustrate the relative positioning or placement of certain components, to indicate a first and a second component or to do both.

Although the disclosed subject matter has been described and illustrated with respect to embodiments thereof, it should be understood by those skilled in the art that features of the disclosed embodiments can be combined, rearranged, etc., to produce additional embodiments within the scope of the invention, and that various other changes, omissions, and additions may be made therein and thereto, without parting from the spirit and scope of the present invention.

What is claimed:

1. A storage container, comprising:

a bottom panel having a front edge and a rear edge parallel thereto, and a first side edge and a second side edge parallel thereto;

a front panel connected to the bottom panel along the front edge, and being further connected with a front locking section;

a first side panel connected to the first side edge of the bottom panel, and being further connected to a first side locking section;

a second side panel connected to the second side edge of the bottom panel, and being further connected to a second side locking section;

a rear panel connected to the rear edge of the bottom panel, and being further connected to a rear locking section;

the rear panel having a first, second, third and fourth deltoidal sections; and wherein the first deltoidal section is connected to a first intermediate panel and the second deltoidal section is connected to a second intermediate panel; and wherein the third deltoidal section and the first intermediate panel are each connected to a first mating panel, and the fourth deltoidal section and the second intermediate panel are each connected to a second mating panel.

2. The storage container of claim 1, further comprising:

wherein the storage container is constructed from cardboard; and wherein at least one of the connections is made by double folding joints.

3. The storage container of claim 2 wherein the first, second, third, and fourth deltoidal sections are defined at least partly by perforation scoring.

4. The storage container of claim 1 wherein the connection of the first deltoidal section to the first intermediate panel and the connection of the second deltoidal section to the second intermediate panel are via glue.

5. The storage container of claim 1 wherein at least one of the first side locking section, second side locking section, the rear edge and the rear panel include perforation scoring.

* * * * *